United States Patent [19]

Beeman et al.

[11] 4,235,566

[45] Nov. 25, 1980

[54] PIPE-CONVEYING CATWALK

[76] Inventors: Archie W. Beeman; Harold D. Beeman, both of 501 Hillcrest, Odessa, Tex. 79761

[21] Appl. No.: 965,895

[22] Filed: Dec. 4, 1978

[51] Int. Cl.[3] ..... E21B 19/00

[52] U.S. Cl. ..... 414/22; 175/85; 414/745; 414/598; 414/728

[58] Field of Search ..... 414/22, 23, 24, 745, 414/598, 569, 728, 742; 89/1.801, 1.804, 1.5 C, 45, 46, 47; 175/52, 85

[56] References Cited

U.S. PATENT DOCUMENTS

| | | | |
|---|---|---|---|
| 1,332,763 | 3/1920 | Schneider | 89/45 X |
| 2,631,741 | 3/1953 | Tucker | 414/22 |
| 2,790,683 | 4/1957 | Clark | 414/22 X |
| 3,217,900 | 11/1965 | Kupetzky et al. | 414/742 |
| 3,651,959 | 3/1972 | Castela et al. | 414/22 |
| 3,916,500 | 11/1975 | Brown | 414/745 X |

*Primary Examiner*—Frank E. Werner
*Attorney, Agent, or Firm*—Marcus L. Bates

[57] ABSTRACT

A pipe-conveying catwalk has a ramp affixed to the floor of a drilling rig and a main frame ground supported adjacent to a pipe rack so that pipe can be conveyed between the rack and the derrick floor. Pipe is rolled from the rack into a trough which forms part of a stinger. The stinger is nested within a boom and can be telescoped to extend longitudinally away from the boom. The boom is retracted into nested position within the main framework. One end of the boom is attached to the main frame by an extensible swing arm apparatus which elevates the outer end of the boom while the other end of the main frame is attached to the rig floor by a ramp which moves the other end of the boom from the nested position vertically upwards and towards the rig floor. A pipe is rolled from the pipe rack into the trough, the boom is elevated into an inclined position such that the stinger telescopes from the boom to position the box end of the pipe in overlying relationship respective to the derrick floor. Roughnecks can then pick the pipe vertically upward into the drilling rig and attach the pipe joint to the pipe string located in a borehole. When coming out of the hole, the opposite procedure is involved in order to transport the pipe from the rig floor back onto the pipe rack.

10 Claims, 7 Drawing Figures

PIPE-CONVEYING CATWALK

BACKGROUND OF THE INVENTION

During borehole-forming operations, it is necessary to make up and break down long strings of tubular goods such as drill pipe. The string of pipe may be thousands of feet long, and it is therefore necessary to transport pipe joints (approximately 33 feet in length) from a pipe rack located away from the rig up to the rig floor. The pipe is vertically supported within the derrick so that it can be connected to the pipe string located in the borehole. In coming out of the hole, the opposite sequence of events must take place.

The handling of oilwell pipe is one of the most dangerous jobs on a drilling rig. Some of the pipe weighs thousands of pounds, and it is difficult to move the pipe from a horizontal position below and away from the rig into a vertical position overlying the turntable within the rig.

Others skilled in the art have proposed various different apparatus by which pipe can be transported between a pipe rack and a rig floor, as for example, Don Beck, U.S. Pat. No. 3,713,547 issued Jan. 30, 1973, and James E. Smart, U.S. Pat. No. 3,494,483 issued Feb. 10, 1970.

It would be desirable to have made available a pipe racking apparatus which is predominantly ground supported, and which additionally is supported at the rig floor so that as the heavy pipe is transported to and from the pipe rack, there is no danger of the pipe or the pipe racking apparatus falling and injuring property and personnel. It would furthermore be desirable if the apparatus could position the pipe at an inclined location with the box end of the pipe overhanging the rig floor in ready access to the elevators. Such an apparatus is the subject of the present invention.

SUMMARY OF THE INVENTION

A pipe racking apparatus in combination with a drilling rig and a pipe rack. The pipe racking apparatus has a main, ground-supported frame member from which there upwardly extends an inclined ramp. The upper end of the ramp is attached to the rig floor and includes a track means thereon.

A boom is attached to the ramp and to the main frame in such a manner that the boom can be retracted into the main frame member, and is extensible into an elevated, inclined position.

A pipe-containing stinger is telescopingly received within the boom and is extensible therefrom in a manner whereby a pipe can be placed within the stinger and elevated by the boom into an inclined position, the stinger is then telescopingly extended from the boom, thereby positioning the box end of the pipe in overlying relationship to the rig floor and in close proximity to the rotating center of the drilling rig.

The remote end of the boom is journaled to a marginal, remote end of the main structure by a swing arm assembly. The swing arm assembly has a journaled end about which the arm can swing. The near end of the boom includes a boom guide which travels within the aforementioned track. When the boom guide is lifted such that it travels upwardly along the inclined track, the swing arms pivotally extend from the main structure, thereby elevating the boom, while at the same time, the boom moves toward the rig floor such that the boom and stinger are positioned at an inclined angle towards the rig floor, with the upper end of the boom being in proximity and slightly above the rig floor. When the stinger is telescoped out of the boom, a marginal end of the pipe is presented to the workmen.

Pipe can be moved from the rig floor, back down to the pipe rack by reversing the above procedure.

Accordingly, the primary object of the present invention is the provision of improved method and apparatus by which joints of pipe can be transported between a pipe rack and a rig floor, and vice versa.

Another object of the invention is to provide a pipe racking machine in combination with a drilling rig which is ground suppported and, at the same time, stabilized by rig structure.

A further object of this invention is to disclose and provide apparatus for transporting pipe between a rig floor and a pipe rack by lifting the pipe vertically upwards and towards the rig floor until the pipe has a marginal end extended in overlying relationship to the rig floor so that the pipe can be safely manipulated as a pipe string is made up or broke out.

A still further object of this invention is to provide apparatus having a ground-supported main structure, a ramp, a swing arm, and a boom which form the sides of a polygon, wherein the boom is retractible into the main structure, and is extensible such that it is inclined at an elevated position so that a pipe can be extended into overlying relationship respective to the rig floor.

Another and still further object of the present invention is the provision of pipe-handling apparatus in combination with a drilling rig which includes a ground-supported main structure and a ramp attached to the drilling rig so that a boom having one end guidably received by the ramp and the other end attached to a swing arm assembly can be manipulated from a retracted into an extended position, whereupon the pipe is extended from the boom and into proximity of the rig floor.

These and various other objects and advantages of the invention will become readily apparent to those skilled in the art upon reading the following detailed description and claims and by referring to the accompanying drawings.

The above objects are attained in accordance with the present invention by the provision of transporting pipe when using the apparatus fabricated in a manner substantially as described in the above abstract and summary.

DETAILED DESCRIPTION OF THE PREFERRED EMBODIMENT

Figure 1:
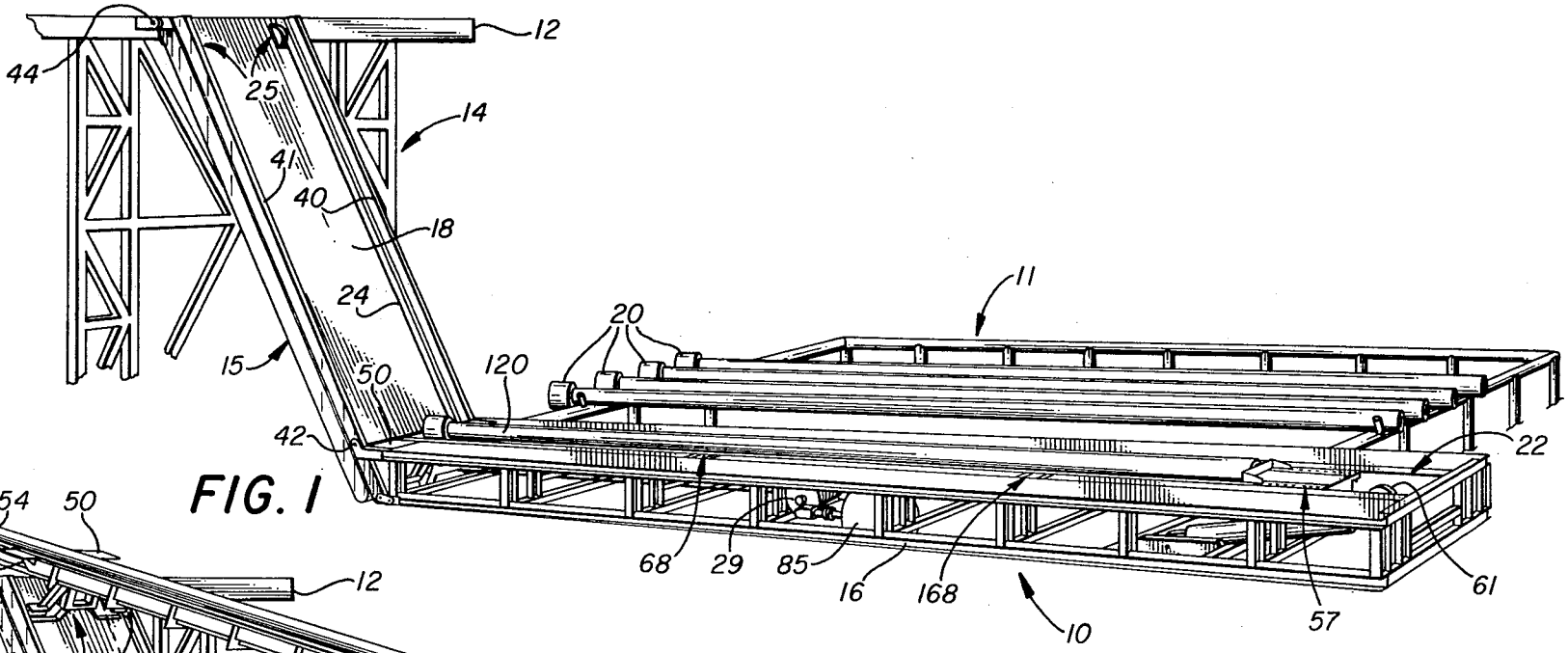
FIG. 1 is a perspective view of a pipe-handling apparatus, made in accordance with the present invention, illustrated in combination with a rig floor and a pipe rack.

In FIG. 1, there is disclosed a pipe-conveying apparatus 10 for conveying pipe from a ground-supported pipe rack 11 onto the floor 12 of a drilling rig 14.

A ramp 15 interconnects a main support structure 16 of the apparatus with the floor of the drilling rig. The ramp includes an inclined surface 18. A plurality of pipe joints 20 are supported by the pipe rack, while one joint of pipe 120 is cradled within a boom 22, the details of which will be more fully disclosed later on herein.

Figure 2:
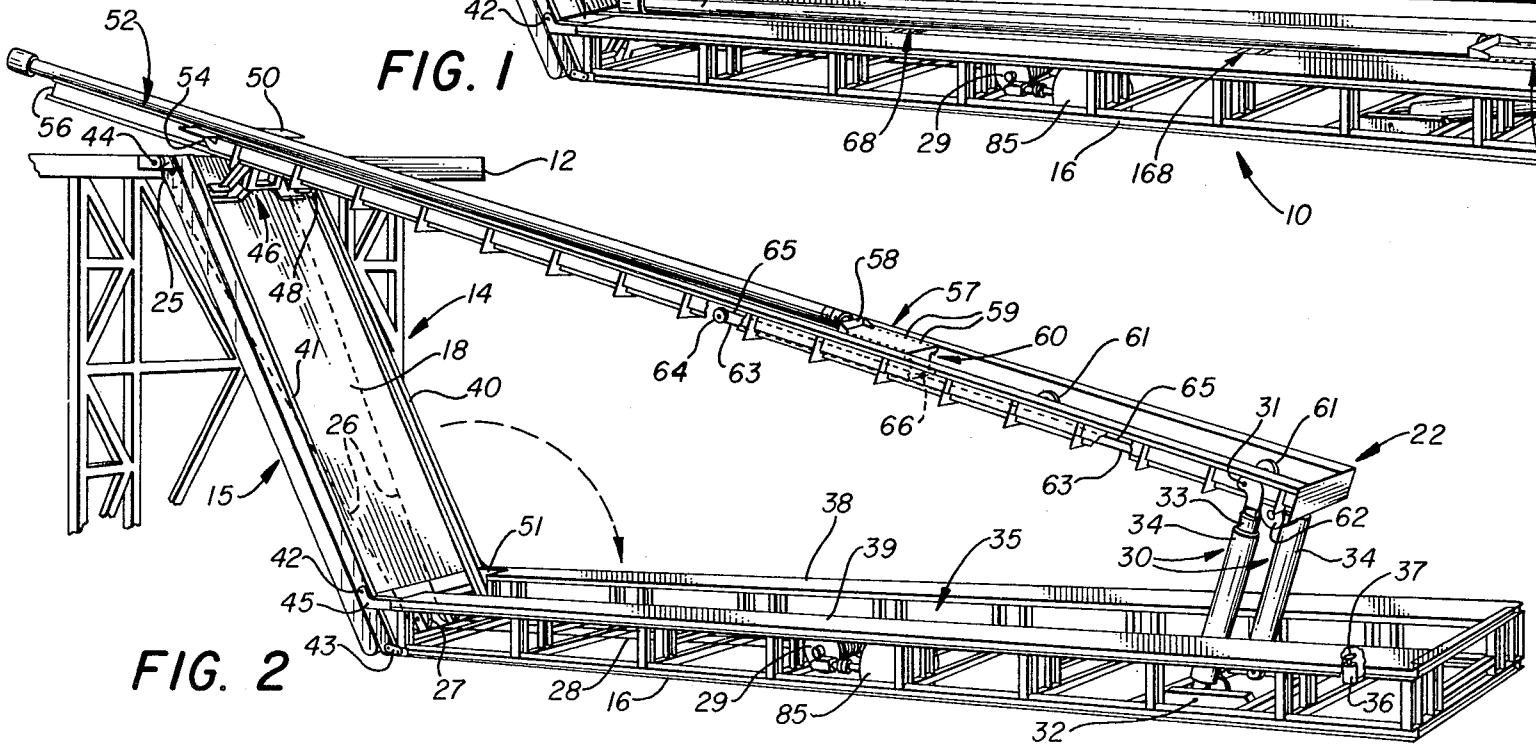
FIG. 2 is an enlarged, perspective view of the apparatus disclosed in FIG. 1, with the apparatus being illustrated in the extended configuration, with some parts being broken away therefrom so as to illustrate additional details thereof.

Spaced-apart cables 24 are roved about upper pulleys 25, and, as seen in FIG. 2, the cables downwardly extend, as indicated by numeral 26, and are roved about a pair of lower pulleys 27, whereupon the cable continues longitudinally of the main structure at 28, where a marginal end of the cable is wound about a cable drum 29. The opposed ends of cables 24 are attached to the near end of boom 22. The term "near end" is the end of the boom attached to the ramp, while the "far end" of the boom is the end opposite to the near end.

A swing arm assembly comprised of spaced hydraulically extendable arms 30 are journaled at 31 to the far end of the boom. The other end of the swing arms is journaled at 32 to the main structure so that journal 31 pivotally swings about journal 32 such that the boom can be retracted into the main structure, as illustrated in FIG. 1, or extended in an arc vertically upward and horizontally toward the rig structure, as illustrated in FIG. 2. The swing arms include piston 33 and cylinder 34. Numeral 35 indicates a longitudinally extending upwardly opening recess formed into the main structure for receiving the boom 22 in retracted configuration therewithin. Hydraulic cylinder 36 causes the piston 37 thereof to engage the far end of the boom to thereby initially assist the extension of the boom from the retracted configuration.

The main structure includes opposed, parallel catwalks 38 and 39, along which workmen may walk and which serve to impart the required structural rigidity into the main structure for adequately supporting the elevated boom therefrom.

As seen in both FIGS. 1 and 2, together with other figures of the drawings, the ramp includes parallel, spaced-apart track members 40 and 41, which are hinged at 42 to the main structure, while hinge pin 44 anchors the ramp to the rig floor. Curved hinged member 45 elevates the axial centerline of the spaced-apart hinge pins, one of which is seen at 42, an amount to enable the ramp to be folded back onto catwalks 39 and 38 when links 43 and pins 44 are removed, thereby enabling the entire pipe-conveying apparatus to be folded into a compact, skid-mounted package for transporting to the next drilling site.

A boom guide 46 is rigidly affixed to the lower near end of the boom and includes opposed ends which are provided with rollers 48. The rollers are received in low-friction captured relationship within the opposed track members 40 and 41. Wings 50 are received within the complementary cutout 51 formed in the near side of the main support structure when the boom is retracted therewithin.

A stinger 52 is telescopingly received within the boom and includes an upper surface area thereof formed into the configuration of the before mentioned cradle so that a pipe 120 received therein gravitates to a lowermost, centrally located position, as illustrated by the various figures of the drawings. The near end of the boom terminates at 54, while the near end of the stinger terminates at 56. The stinger can be telescoped so that one-half of its length is extended from the boom and can be completely telescoped into the boom.

A pipe stop member 57 forms the far marginal end of the stinger and is provided with adjustable plate member 58. The plate member has downwardly depending lugs which can be received within any opposed pair of apertures 59 to compensate for variation in pipe length. Opposed longitudinal upper and lower sides of the stinger are made into a configuration of outwardly directed guide members 60, which guidably receive a plurality of rollers 61 in low-friction relationship. The rollers are spaced longitudinally along the interior sidewall of the boom with the rollers being captured within the V-shaped grooves formed longitudinally along each opposed sidewall of the stinger.

Hydraulically-actuated stinger winch drum 62 is provided with appropriate hydraulic flow conduits (not shown). Cables 63 and 65 are positioned in underlying relationship respective to the stinger and above the lowermost lateral members which tie the longitudinal sides of the boom together. The cable 63 extends in a forward direction and is roved about horizontally disposed pulley 64 and back at 65, where the end of the cable is affixed by conventional means to the marginal far end of the stinger. Pulley 64, winch drum 62, and cable end 66 are arranged respective to one another whereby the length of telescoping travel of the stinger is equal to approximately one half the length of the boom, while the boom is almost as long as the entire main structure.

Figure 3:
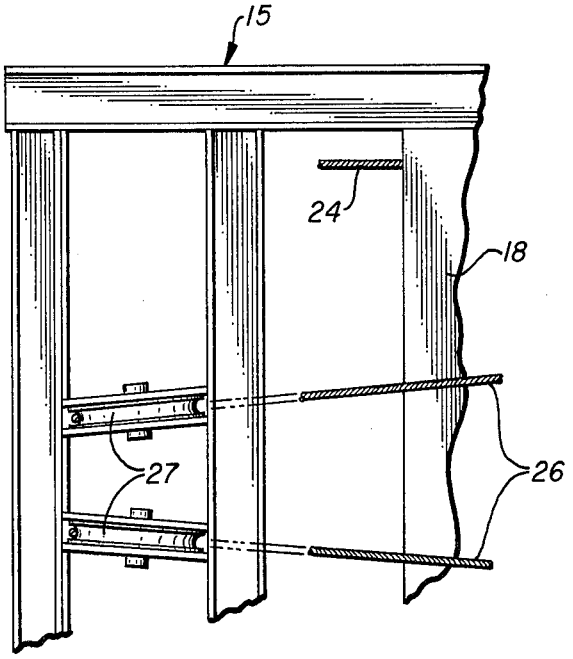
FIG. 3 is a fragmented, top, detailed view of part of the apparatus disclosed in the foregoing figures.

FIG. 3 discloses the near end of the main support structure, and the pair of pulleys 27 which guidably receive the pair of cables 26 for lifting the boom guide within the spaced-apart tracks.

Figure 4:
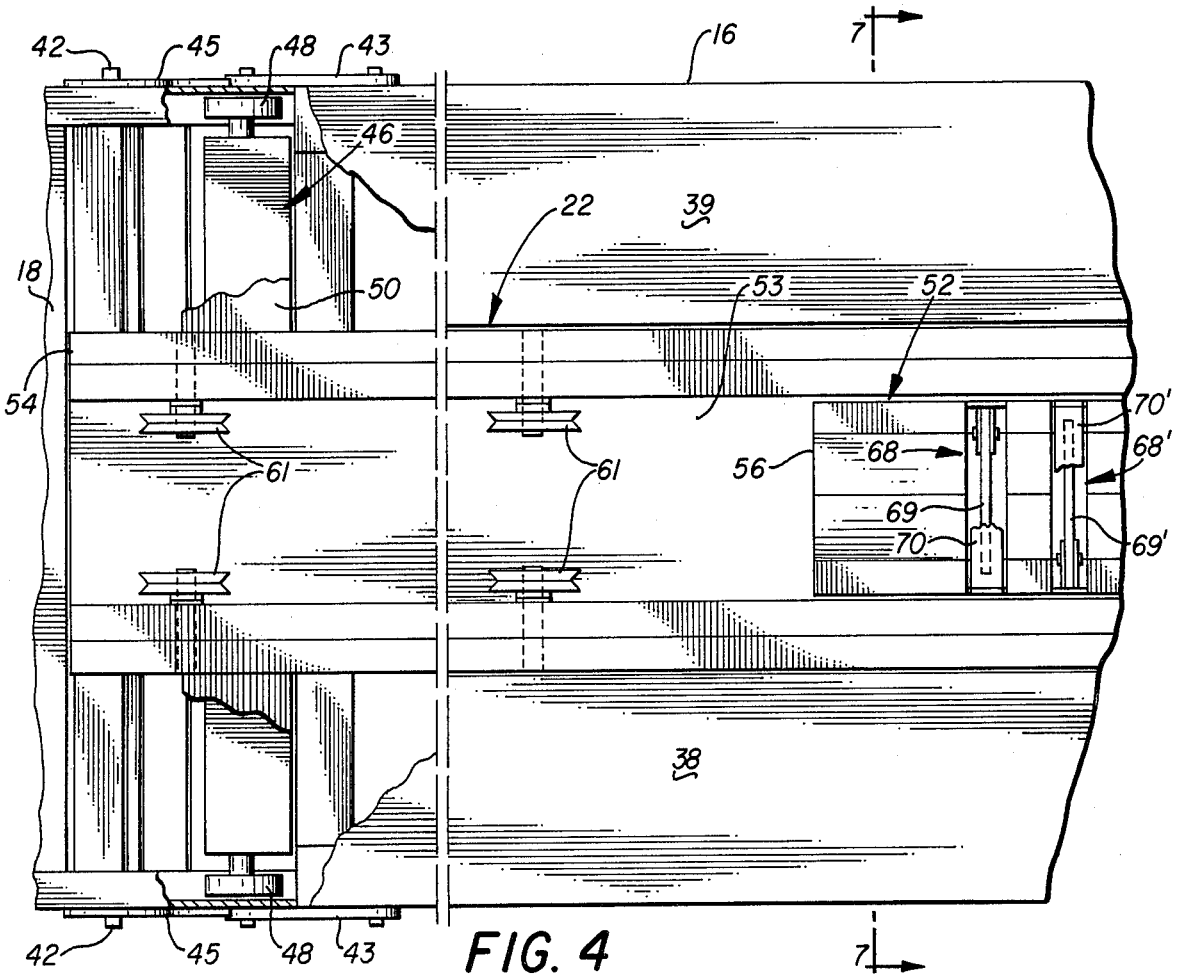
FIG. 4 is a fragmented, top, plan view of part of the apparatus disclosed in FIGS. 1 and 2.
Figure 5:
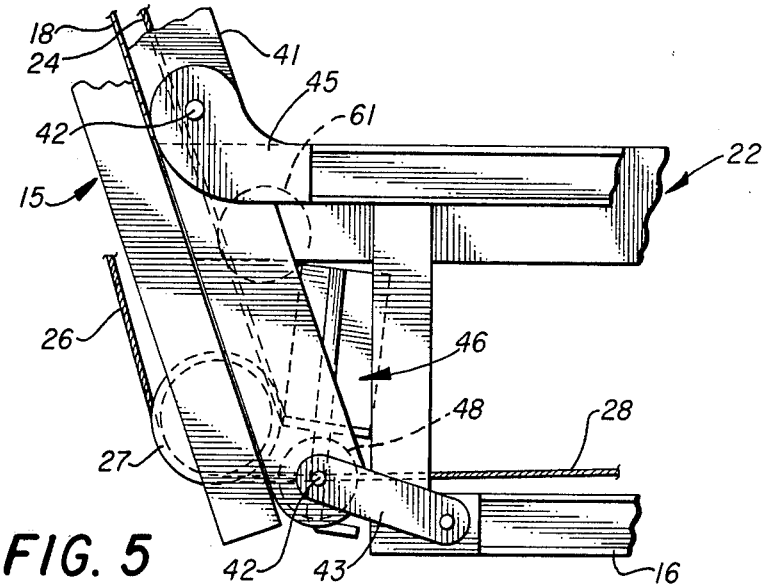
FIG. 5 is a broken, side elevational view of part of the apparatus disclosed in the foregoing figures.

FIG. 4 shows the spaced-apart tracks 40 and 41 which receive the spaced-apart rollers 48 of the boom guide 46. The boom 22 includes a plurality of opposed, spaced-apart pairs of the before mentioned rollers 61 which telescopingly capture the stinger in a slidable manner therewithin. The stinger includes the before mentioned V-shaped trough 53 which upwardly opens so that a pipe gravitates into a centrally located position therewithin.

Figure 6:
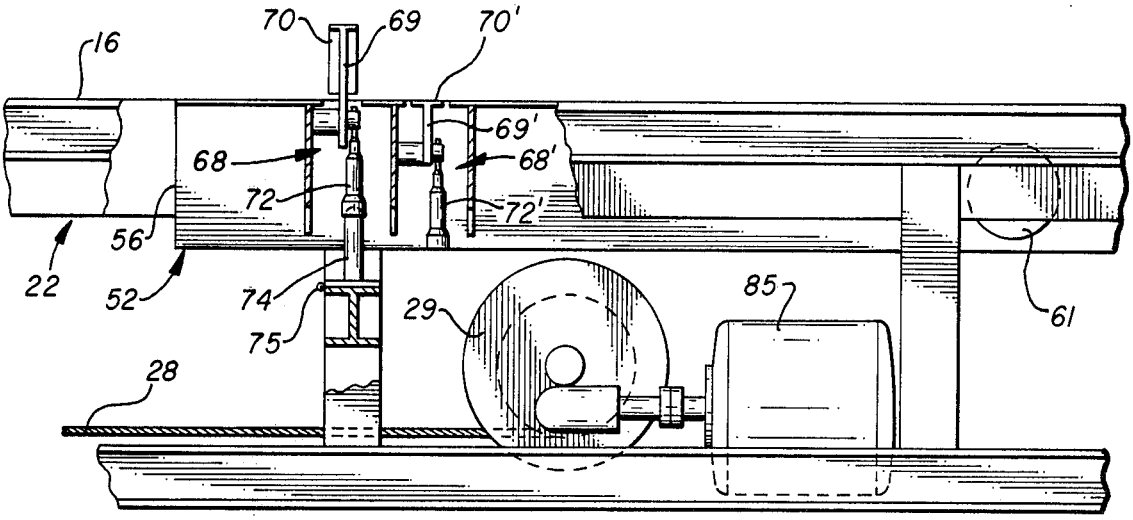
FIG. 6 is a broken, side elevational, part cross-sectional, detailed view of part of the apparatus disclosed in the foregoing figures; and, FIG. 7 is a cross-sectional view taken along line 7—7 of FIG. 4.
Figure 7:
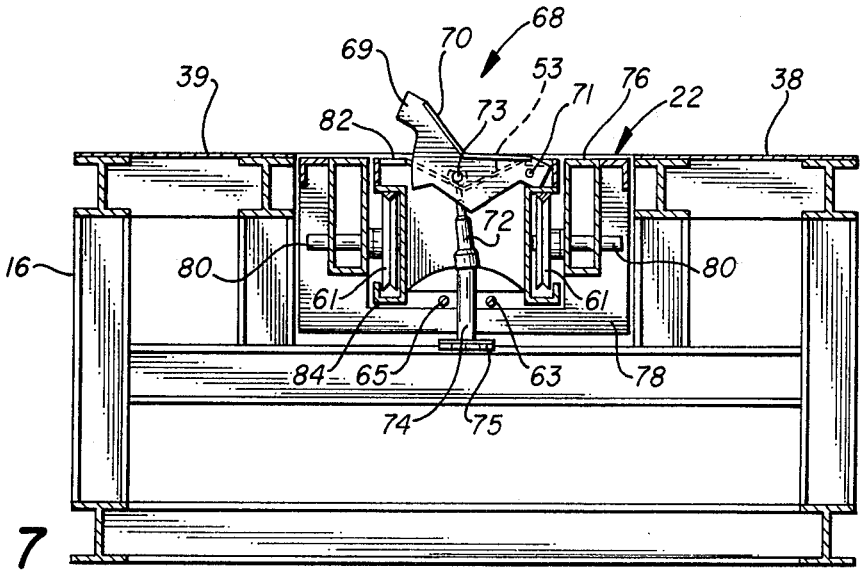

Looking to the details of FIGS. 4, 6, and 7, there is disclosed a pipe-dumping apparatus 68 and 68'. The pipe-dumping apparatus is located at spaced-apart locations, as indicated by numerals 68, 168 in FIG. 1. Only one pipe-dumping apparatus 68 has been illustrated in FIGS. 4, 6, and 7. Dumping arm 69 has an upper V-shaped surface 70 of limited width which bears against the pipe and coincides with the V-shaped, upper surface of the cradle. The dumping arm is pivoted at 71 so that actuator 72 can move off-center pivot pin 73 to dump the pipe from the trough so that the pipe rolls toward the right as viewed in FIG. 7. Accordingly, as the boom is retracted into the main structure, stationary lifter member 74 reciprocates member 72, which in turn raises member 69 and dumps the pipe. Member 74 is hinged at its base 75 so that one of the devices 68 or 68' can be rendered inoperative by folding down the appropriate member 74.

Each location 68 and 168 includes two dumping apparatus 68 and 68', as best seen illustrated in FIGS. 6 and 7. It will be noted that stationary lifter 74 has been positioned in underlying relationship to actuator 72 of dumping member 69 and there is no stationary lifter under member 72' of dumping apparatus 69'. When it is desired to dump pipe to the left (FIG. 7) rather than to the right, member 74 is positioned under dumping arm 72'.

As best seen in FIG. 7, the stinger 52 is seen to be telescoped into the retracted configuration respective to the boom 22, while the boom 22 is seen to be retracted into the main support member 16. The boom includes opposed parallel cantilever arms 76 which are tied together by spaced apart lateral web members 78. Attachment 80 secures the spaced pairs of rollers 61 to the spaced apart, parallel, coextensive, cantilever arms. The stinger includes upper and lower rail members 82 and 84 which form opposite opening longitudinal slots which capture the rollers 61 therewithin so that the stinger is telescopingly captured in a reciprocating manner within the boom.

In operation, the apparatus is delivered to the new drilling site along with the drilling rig. After the derrick has been erected, the ramp 15 is unfolded into the operative position of FIG. 1, with the pins 42, 43, and 44 holding the main structure in attached relationship respective to the floor of the derrick. The pipe racks are assembled and positioned on either side of the main structure 16 so that new pipe to be used can be placed on one side of the apparatus while pipe which comes out of the hole can be placed on the opposed side of the structure. When the drilling operation commences, drill pipe, or other tubular goods, are rolled from the pipe rack and into the trough. The motor 85 energizes winch 29 which pulls the cables 24 at 28, thereby elevating the boom guide from the position of FIG. 1 into the position of FIG. 2.

The assist cylinder 36 is actuated simultaneously with the motor 85 to reduce the initial power requirement of the motor 85 and winch 29.

When the boom guide has assumed the inclined configuration of FIG. 2, hydraulic winch 62 is energized to pull cable 63 which telescopes the stinger towards the rotating center of the rig. The pistons 33 are extended from the cylinders 34 as the boom guide approaches the end of upward travel in order to reduce the elevation of the box end of the pipe respective to the floor 12. This action positions the marginal box end of the drill pipe in close proximity to the elevators which are latched onto the box end of the tubing. The tubing picked up towards the top of the derrick until it is vertically disposed in axially aligned relationship respective to the borehole. The tubing is lowered into the rotating center so that the pin end engages the box end of the drill string, the power tongs make up the tubing, the kelly is mated to the box end of the string. The drilling operation is resumed until another thirty-three feet of hole has been made, whereupon the operator of the pipe conveying apparatus will have already transported another joint of drill pipe from the pipe rack up onto the drill floor in the manner of FIG. 2. The operation continues in this manner with hole being made at a rate which will delight the most demanding tool pusher.

When time comes to make a trip into the hole with a new or different drill string, the string is broke out in the usual manner. As the elevator lifts the individual joints, the lower end thereof is moved towards the boom until the pin end engages the extended marginal end 56 of the stinger. The traveling block is lowered as the pipe slides down the trough and is received against stop 58 in the manner of FIG. 2. The stinger is telescoped into the boom by actuating hydraulic winch 62. The boom is next retracted into the main structure whereupon the automatic pipe dumping apparatus 68 and 168 causes the joint of pipe to move onto either of the before described pipe racks. Selection of the direction of travel of the pipe is achieved by placing stationary member 74 under either of the actuators 72 or 72', as in the before described manner.

When it is time to relocate the drilling rig, the pins at link 43 and the pin 44 at the floor are removed, the ramp is carefully folded about hinge pin 42, whereupon the entire apparatus is winched up onto the tailgate of an oilfield truck and transported to the next drill site where it is again erected in the before described manner.

The apparatus of the present invention preferably is a permanent part of a drilling rig. By ground supporting the main structure and tying the upper free end of the ramp to the rig floor, there is virtually no manner in which the apparatus can inadvertently assume any dangerous movement during the translocation of pipe between a pipe rack and the derrick floor.

I claim:

1. In a drilling rig for forming boreholes which has a pipe rack situated in spaced relationship to a rig floor and means by which piping is run into and out of the borehole, the combination with said drilling rig of a pipe-conveying apparatus by which pipe is transported from the pipe rack to the rig floor, and vice versa;

said pipe-conveying apparatus having an elongated, ground-supported main frame, an elongated boom supported by said main frame, said boom and said main frame having a remote end opposed to a near end, the near end being the end closest to the drilling rig;

a ramp having an upper and a lower end, said ramp includes an inclined track means, said upper end of the ramp being attached to the rig floor and said lower end of the ramp being attached to the near end of the main frame, a boom guide captured by the track means and connected to the near end of the boom, means for moving said boom guide along the track means so that when the boom guide is moved up the track means, the near end of the boom is elevated into close proximity of the drill floor and vertically positioned above the far end of the boom;

means connecting said remote end of said boom to the remote end of said main frame to cause the remote end of the boom to be lifted vertically upwards and towards the rig floor concurrently with upward movement of said boom guide;

a stinger having an upper surface in the form of a pipe-receiving trough; said stinger having a near end and a far end, means by which said stinger is reciprocatingly supported respective to said boom in a manner that the stinger can be telescoped into the boom and a marginal end thereof extended therefrom; means for moving the stinger respective to the boom;

so that when the boom is elevated by the boom guide, the stinger can be extended from the boom so that the near marginal end of a pipe supported within the trough is disposed in overlying relationship respective to the rig floor.

2. The combination of claim 1 wherein said means connecting said remote end of said boom to the remote end of said main frame includes a swing arm assembly, said swing arm assembly has opposed ends with a journal formed at each of said opposed ends, one opposed end being journaled to said main frame and the other of said opposed ends being journaled to said boom;

said main frame and boom form opposed sides of a polygon while said ramp and said swing arm assembly form opposed, connecting sides of said polygon when said boom is in the extended configuration; and when said boom guide is at its lowermost position, said boom is retracted into said main frame.

3. The combination of claim 2 wherein said ramp is pivotally attached to the near end of said main frame and removably attached to said rig floor so that said ramp can be folded down onto said main frame to thereby provide a low profile package which can be easily transported from one drill site to another.

4. The combination of claim 3 wherein said boom guide supports the near end of said boom and underlies said boom, rollers disposed on opposed sides of said boom guide in underlying relationship to said boom, said track being located on opposed sides of the ramp and capture said rollers therewithin.

5. The combination of claim 4 wherein said boom guide is actuated by a cable means roved about a pulley located at the upper extremity of said track and roved to a winch located within said main frame;

said stinger is telescoped out of and into said boom by means of a winch-operated cable means.

6. The combination of claim 2 wherein said swing arm assembly is a hydraulically actuated piston and cylinder, means for extending said piston during the extension of the boom from the main frame so that the length of the swing arm assembly can be increased and thereby lower the near end of the stinger relative to the derrick floor when the boom is in the extended configuration.

7. A pipe-conveying apparatus for moving pipe between a rig floor and a pipe rack which is spaced vertically below and horizontally away from the rig floor;

said apparatus includes a ground-supported main structure, a boom, a swing arm assembly, an elevator; and a pipe-receiving stinger;

said boom and said main structure having a near end adapted to be placed near a drilling rig and a far end remote from said near end, means by which one end of said elevator can be attached to the near end of said main structure and the other end of said elevator can be attached to a rig floor of a drilling rig;

said elevator includes a boom guide attached to said near end of said boom so that the near end of the boom can be moved vertically upwardly and at the same time horizontally away from said far end of said main structure, whereupon the near end of the boom can be elevated into proximity of a rig floor; means for moving said boom guide respective to the main structure;

said swing arm assembly has a swing end and a pivoted end, said swing end being journaled to the far end of said boom, said pivoted end being journaled to the marginal, far end of said main structure so that when the elevator lifts the near end of the boom, the far end thereof is lifted vertically up and horizontally towards the near end of the main structure;

means by which said stinger is supported for reciprocal movement respective to said boom, so that a pipe which is supported by the stinger can be telescopingly moved in a direction towards and away from said far end of said boom, whereupon the boom is elevated and the stinger extended over a rig floor; thereby enabling a pipe to be transported between a pipe rack and a rig floor.

8. The apparatus of claim 7 wherein said boom, swing arm assembly, elevator, and main structure each form one side of a polygon when the apparatus is in the extended configuration;

and said boom is positioned parallel to said main structure when the boom is in the retracted configuration.

9. The apparatus of claim 8 wherein said boom is received within said main structure when the apparatus is in the retracted configuration.

10. The apparatus of claim 7 wherein said swing arm assembly includes two spaced-apart, telescoping members placed on opposed sides of the boom, means for extending the length of the swing arms as the boom is extended from the main structure.

* * * * *